US005775038A

United States Patent [19]

Sauvageot

[11] Patent Number: 5,775,038

[45] Date of Patent: Jul. 7, 1998

[54] FIXED POINT SEISMIC BUFFER SYSTEM

[75] Inventor: Gerard A. Sauvageot, San Diego, Calif.

[73] Assignee: J. Muller International, San Diego, Calif.

[21] Appl. No.: 770,854

[22] Filed: Dec. 20, 1996

[51] Int. Cl.[6] ..... E04B 1/98; E02D 31/08; E04H 9/02

[52] U.S. Cl. ..... 52/167.8; 14/73.5; 52/167.1; 52/167.3; 405/229

[58] Field of Search ..... 52/1, 167.1, 167.3, 52/167.4, 167.7, 167.8; 14/73, 73.1, 73.5, 75; 405/229, 230, 231

[56] References Cited

U.S. PATENT DOCUMENTS

| | | | |
|---|---|---|---|
| 468,186 | 2/1892 | Beardsley | 52/167.4 X |
| 3,283,515 | 11/1966 | Pottorf | 52/167.1 X |
| 3,794,277 | 2/1974 | Smedley et al. | 52/167.8 X |
| 3,986,367 | 10/1976 | Kalpins | 52/167.4 X |
| 4,106,301 | 8/1978 | Gerwick, Jr. | 52/167.4 X |

FOREIGN PATENT DOCUMENTS

| | | | |
|---|---|---|---|
| 63-247428 | 10/1988 | Japan | 52/167.8 |
| 1-203542 | 8/1989 | Japan | 52/167.7 |
| 4-143346 | 5/1992 | Japan | 52/167.8 |
| 4-266642 | 9/1992 | Japan | 52/167.8 |
| 5-65762 | 3/1993 | Japan | 52/167.4 |
| 429164 | 5/1974 | U.S.S.R. | 52/167.4 |
| 1286682 | 1/1987 | U.S.S.R. | 52/167.4 |

OTHER PUBLICATIONS

"Earthquakes Will Not Damage This Bridge", Gary M. Snyder et al., Civil Engineering Magazine, Sep. 1987.

*Primary Examiner*—Carl D. Friedman
*Assistant Examiner*—Kevin D. Wilkens
*Attorney, Agent, or Firm*—Baker, Maxham, Jester & Meador

[57] ABSTRACT

A seismic damping system for a building structure, comprises a foundation for supporting a structure, a fixed anchor disposed in an accessible position centrally of the foundation, and damping members connected between the foundation and the anchor for damping seismic movement of the foundation.

19 Claims, 5 Drawing Sheets

FIXED POINT SEISMIC BUFFER SYSTEM

BACKGROUND OF THE INVENTION

The present invention relates to building structures and pertains particularly to improved earthquake resistant structures.

The destructive forces of earthquakes on man-made structures are well known. Man has long sought means and techniques for reducing or eliminating the damage done to man-made structures by earthquakes. One well-known technique for the reduction in the destructive forces of earthquakes on man-made structures is the use of buffers to dampen the movement of the structure during earthquakes. The majority of these dampers are bearings or other systems that are placed between the foundations of the structure and the structure itself and that create the damping effect by deformity or by the velocity of the products incorporated in them.

An example of the prior art is illustrated in FIG. 1 of the drawings, wherein a large structure designated generally by the numeral 10, is mounted atop a foundation 12. The foundation is positioned at approximate ground level and supported on a plurality of straight pilings 14 and a plurality of angled pilings 16. The foundation 12 is positioned approximately level with the upper surface level of the ground 18 with the pilings extending from the foundation down to bedrock structure 20.

In the illustrated embodiment the structure 10 rests on a plurality of dampers 22 disposed on the top of the foundation 12. As illustrated, these support the weight of the structure and therefore cannot be easily removed and replaced if they should be damaged. In the illustrated embodiment the building is formed with a recess 24 that rests on a upwardly projecting structure 26 to buffer and maintain the structure centrally on the foundation. In these systems the buffer supports the weight of the structure and therefor cannot easily be replaced. Furthermore, the buffer is located in the foundation of the structure and when the foundation settles or is otherwise damaged, its efficiency is considerably reduced.

Bridges and high-rise buildings are the structures most often affected by earthquakes. While the sites for buildings can normally be carefully selected to minimize earthquake damage, bridges cannot always be so conveniently located. Bridges are often built as large structures on poor quality sub-soil, or over deep waters. In these cases, these structures are usually mounted on vertical piles or drill-shafts in order to create a flexible foundation system that reduces the seismic forces induced in the structure. However, in high seismic areas these may not be sufficient to keep the forces under acceptable limits.

The present invention was designed to overcome the above problems and predominantly for application to bridges. However, it has equal application to other structures, such as high-rise buildings. The term building structure is intended to include any man made structure whether bridge, high rise building, or any other structure.

Accordingly, it is desirable that improved damping apparatus be available for reducing the movement and resultant destructive forces of earthquakes on large structures.

SUMMARY AND OBJECTS OF THE INVENTION

It is the primary object of the present invention to provide improved damping means for large structures to reduce the movement and resultant destructive forces of earthquakes on such structures.

In accordance with a primary aspect of the present invention, a seismic damping system for large building structures comprises a foundation for supporting the structure, a fixed anchor disposed in an accessible location centrally of said foundation, and damping means disposed between and connected between said foundation and said anchor for damping seismic movement and resultant forces on said foundation.

BRIEF DESCRIPTION OF THE DRAWINGS

The above and other objects and advantages of the present invention will become apparent from the following description when read in conjunction with the accompanying drawings wherein.

DETAILED DESCRIPTION OF A PREFERRED EMBODIMENT

Figure 1:
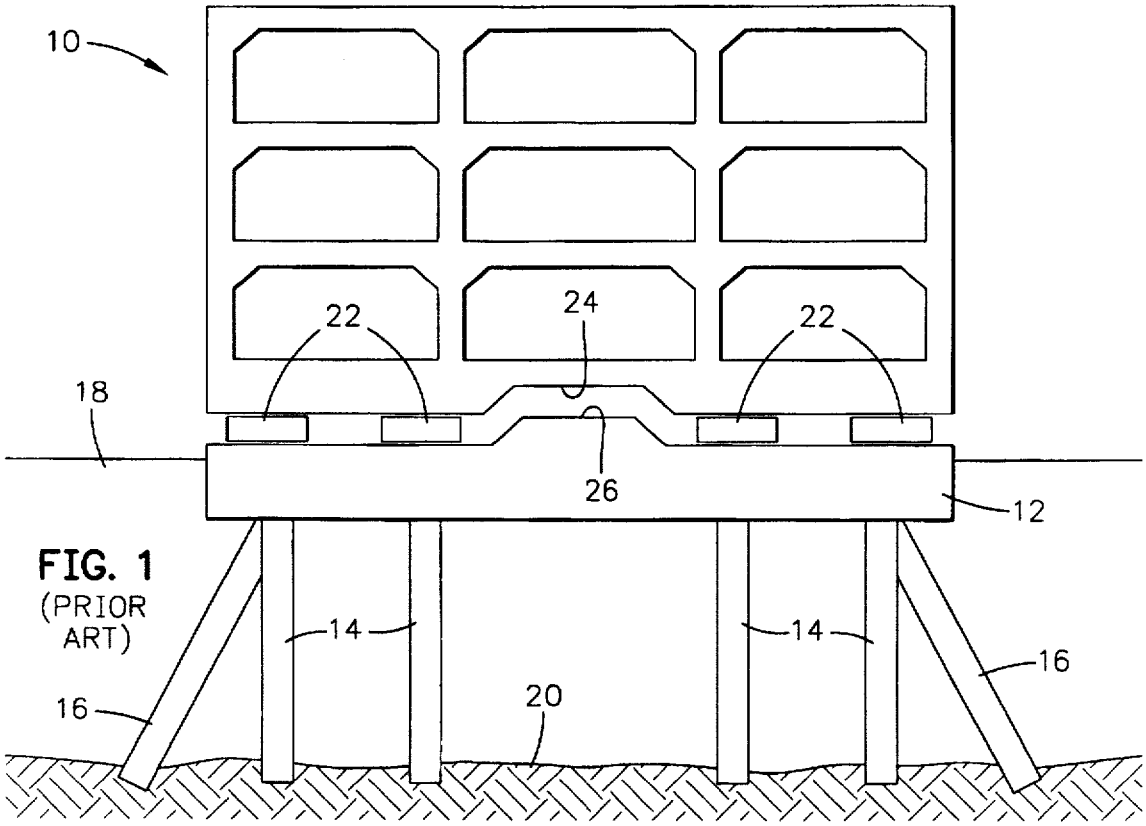
FIG. 1 (PRIOR ART)
FIG. 1 is an exemplary illustration of a prior art damping structure.
Figure 2:
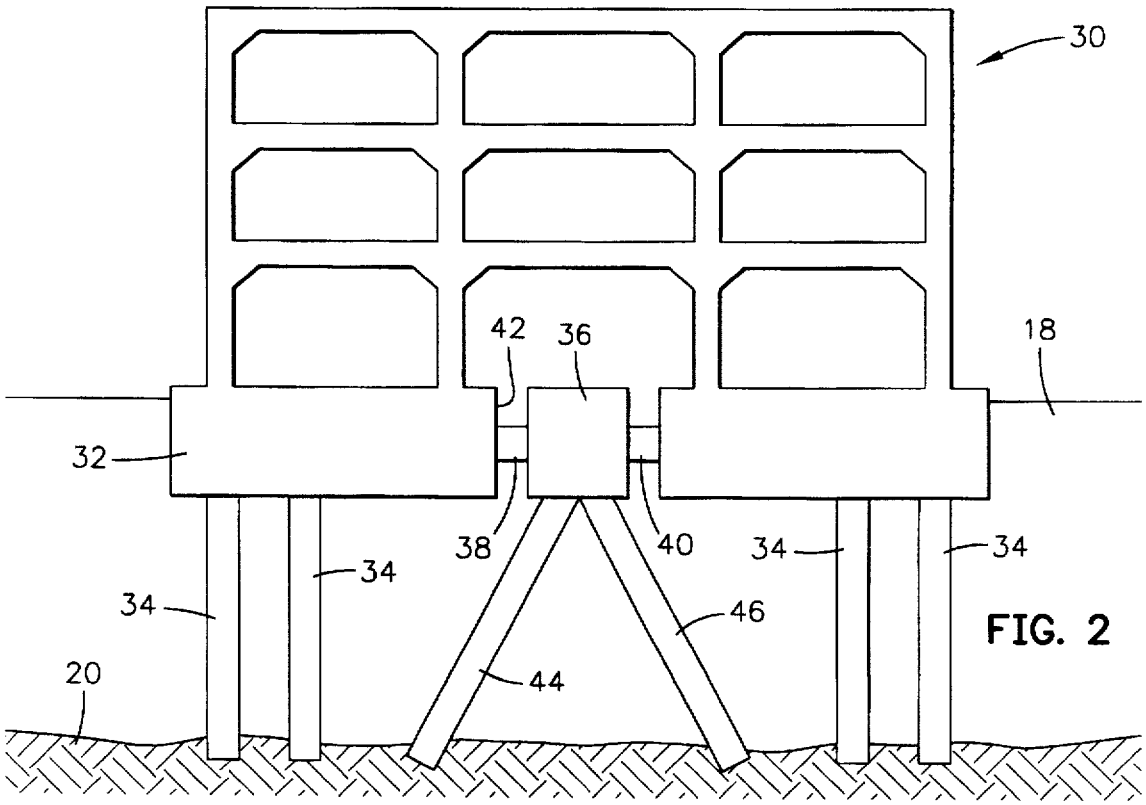
FIG. 2 is an illustration of a structure like FIG. 1 embodying the present invention.

Referring to FIG. 2, a building structure substantially like that of FIG. 1 is illustrated supported on a fixed point seismic buffer system, in accordance with the present invention. The structure 30 is mounted on a foundation 32 which is supported at ground level on a plurality of vertical pilings 34. The foundation may be a foundation for a high-rise building or for the pylons of a bridge. The pilings 34 extend from the foundation at ground surface down to bedrock 20 for securely anchoring and supporting the foundation. The pilings are strictly vertical and thus have flexibility to enable the foundation to move with the flexing of the pilings in response to earthquake forces.

A fixed point or anchor system in accordance with the present invention comprises a fixed point or anchor 36 positioned centrally of the foundation 32, substantially in the plane thereof with a plurality of dampers only two of which, 38 and 40, are shown positioned and operatively connected between the fixed point or anchor 36 and the foundation 32. In the illustrated embodiment the anchor 36 is positioned within an aperture or hole 42 in the center of the foundation. It is positioned so that access may be provided to it from the top inside the structure 30. Thus, it is positioned for maintenance and repair, should damage occur to it during an earthquake.

The anchor 36 is supported at the top of an array of battered piles, only two of which, 44 and 46, are shown. The term battered piles means, pilings that are not vertical, that is, they are leaning from the vertical. The battered pilings 44 and 46 are preferably formed in the shape of a pyramid or tripod structure. The bottom of the battered pilings extends downward and are preferably anchored in the rock 20.

In certain situations, particularly where uplift forces are great, the battered pilings are preferably securely anchored in the bed rock or secured to the adjacent vertical pilings for the foundation structure. The securing of the battered pilings to adjacent vertical pilings takes advantage of the weight of the structure to hold the fixed anchor against vertical uplifting forces.

The structure of the present invention, as described, can be utilized for any large structure, such as buildings and bridge structures that may be subject to earthquakes. In either case, the basic foundation and support structure is the same with possible placement with what has been termed the foundation being different depending on the terrain. For high-rise office and apartment buildings, for example, the foundation will be preferably placed at ground level, as illustrated in FIG. 2. However, for bridge structures the foundation which will be supported at the top of the pilings or the piling cap, may be positioned above ground surface level to similarly position it at or above normal water level.

Figure 3:
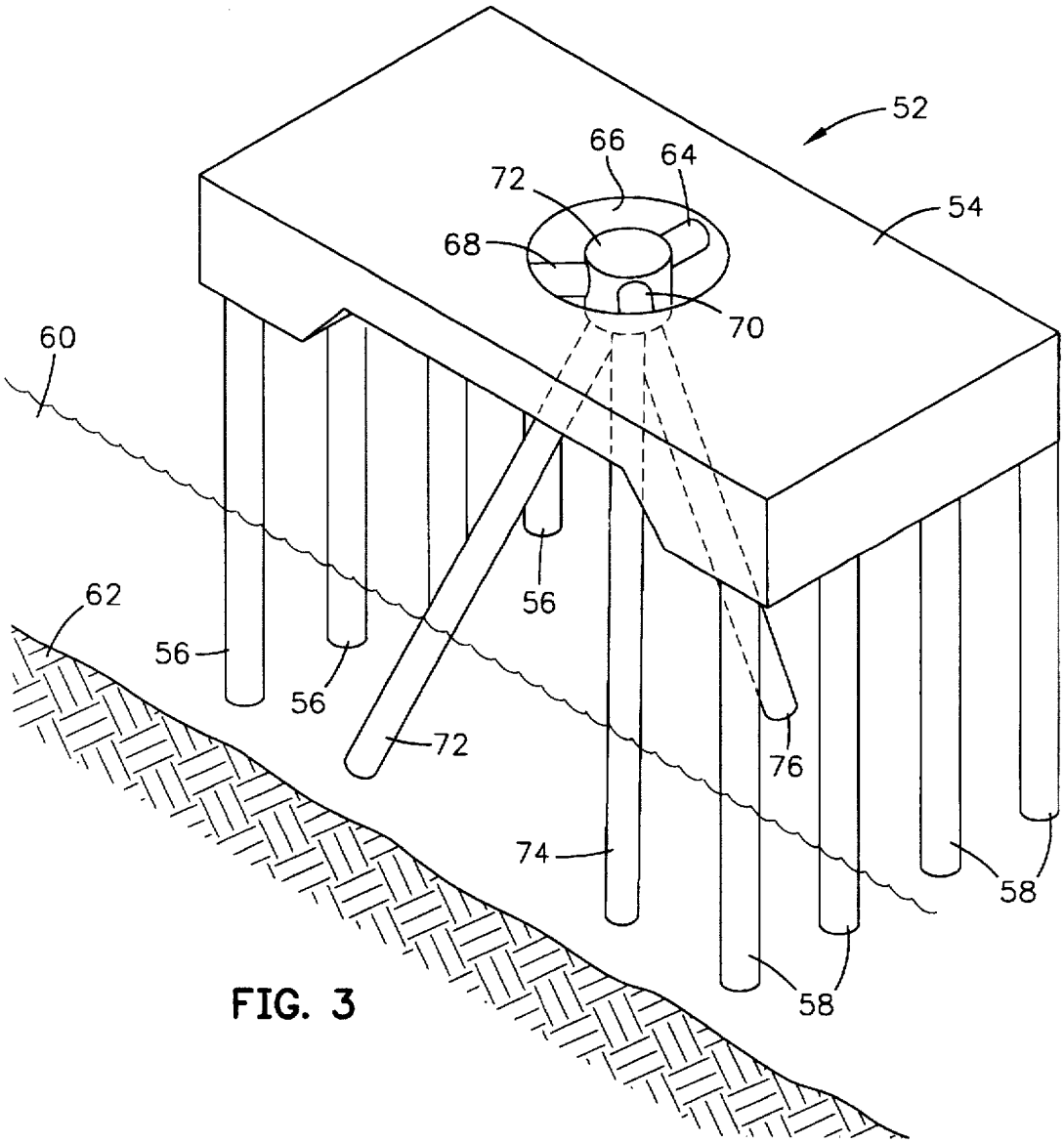
FIG. 3 is a perspective view of an alternate embodiment of a foundation structure.

Referring to FIG. 3, a foundation structure suitable for a bridge or building is illustrated, but primarily set up for that of a big bridge structure. The system as illustrated designated generally by the numeral 52 comprises a foundation structure 54 mounted at the top or caps of two rows of vertical pilings 56 and 58. There may be additional rows of pilings, as necessary or desired. The pilings in the illustrated embodiment support the foundation or platform 54 above ground surface level 60 and extend downward to and may be secured to rock formation level 62. A fixed point or anchor 64 is disposed essentially in the plane of the foundation structure 54 in a hole or bore 66, located and constructed to provide access from above. Within the hole or opening 66 is a plurality of dampers 68, 70 and 72. These may take any form, such as adjustable hydraulic jacks, or any other suitable viscous dampers. This positions the dampers for accessibility for maintenance, repair or replacement, as desired.

The fixed point or anchor 64 is mounted on the top of an array of battered pilings positioned in a tripod configuration. The pilings 74, 76 and 78 extend downward to the bedrock as the other pilings. These pilings may also be secured at ground level or below to the other vertical pilings 56 and 58. This would assist in resisting uplifting forces that may occur. They may also be suitably anchored in the bed rock.

This invention provides a two-level damping system, wherein the flexibility in the pilings or primary supporting structure provides the primary damping system. The fixed point or anchor position system provides a secondary damping system which may take over under high displacement conditions and will absorb and dissipate the increased or larger seismic movement and forces.

Figure 4:
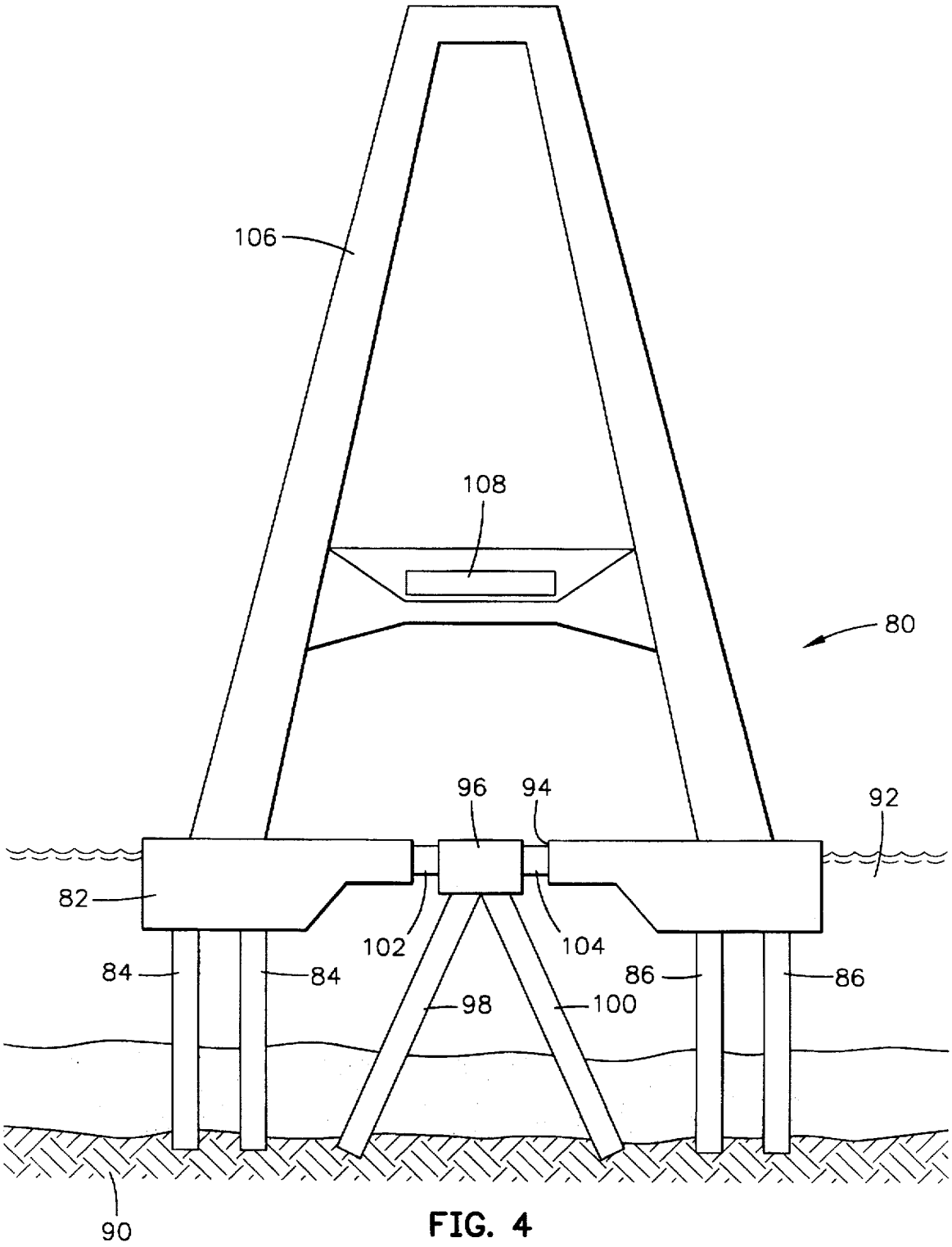
FIG. 4 is an end elevation view illustrating application of the present invention to a bridge structure.

Referring now to FIG. 4, the application of the present invention to a bridge structure is illustrated and designated generally by the numeral 80. The system comprises a suitable platform or foundation 82 mounted on top of rows of vertical piles 84 and 86. The pilings support the platform or foundation 82 above a ground surface 88, and further extend down to a rock level or foundation 90. The platform or foundation 82 is generally in the plane or level of the surface of a body of water 92. Disposed in an opening 94 in the center of the foundation platform 82 is a fixed point anchor 96 mounted on top of a plurality of battered pilings 98 and 100. Suitable dampers, only two of which are shown, 102 and 104, are disposed in the opening 94 between the fixed anchor 96 and the foundation platform 82. The dampers are positioned and arranged to absorb forces in any direction about the vertical axis of the anchor. Mounted on top of the foundation or platform 82 is a bridge pylon structure 106 with a roadway structure 108.

Figure 6:
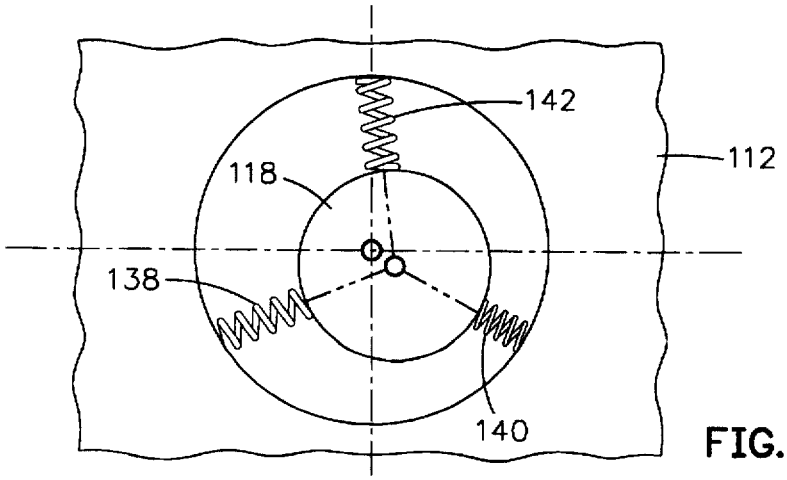
FIG. 6 illustrates movement of the building structure relative to the damping anchor of an embodiment of FIG. 5.
Figure 5:
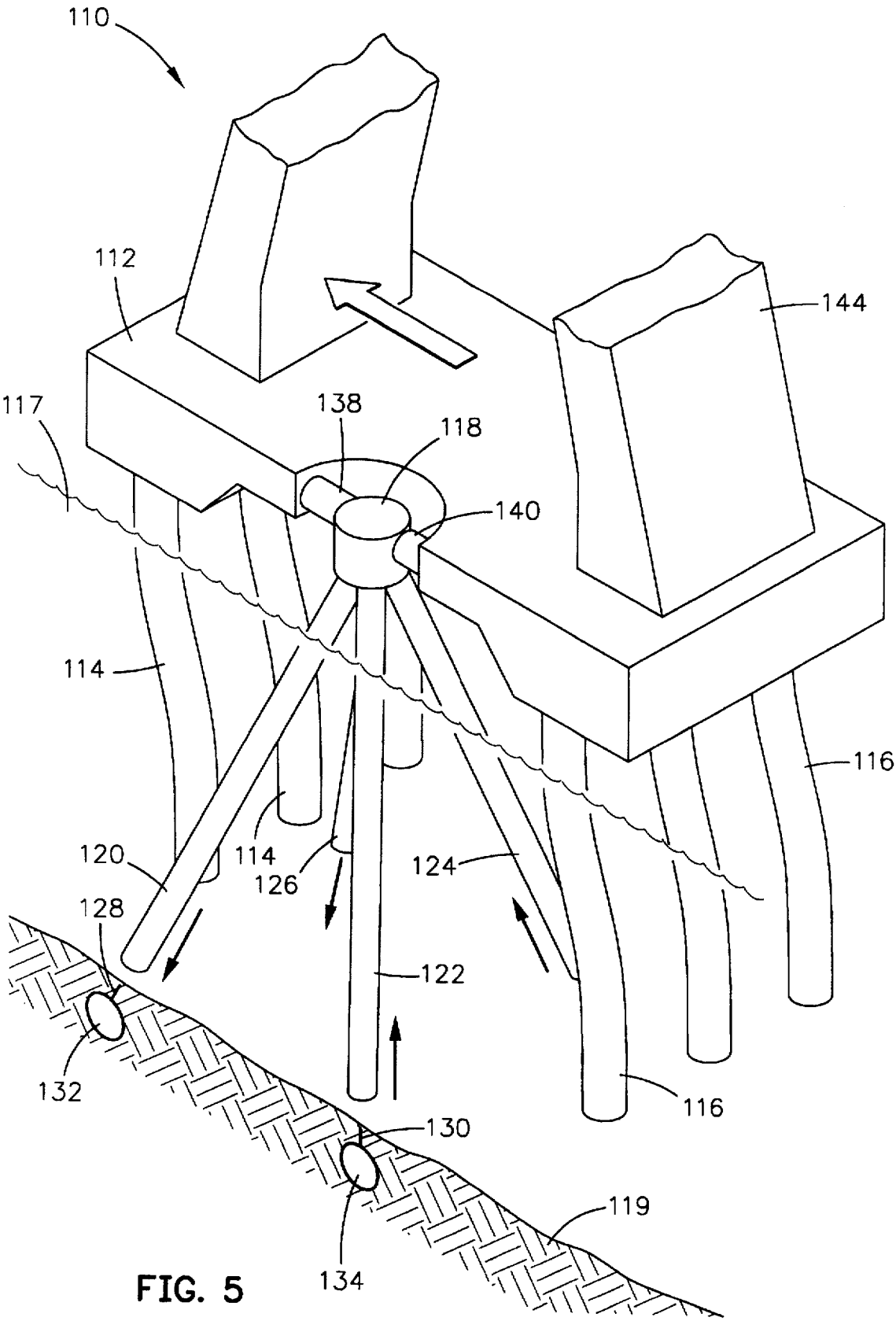
FIG. 5 is an illustration of the forces and movement of the embodiment of FIG. 4 under earthquake forces.

Referring to FIGS. 5 and 6, an embodiment is illustrated and designated generally by the numeral 110 which is shown to be additionally anchored and illustrates examples of displacement during an earthquake. The illustrated embodiment comprises a foundation or platform 112 supported on vertical pilings 114 and 116, which are extended into and below ground surface 117 into and anchored to rock formation 119. The pilings 114 and 116 may be further anchored in the rock formation by suitable means, such as cables or concrete and the like. A fixed point or anchor 118 is mounted on top of a plurality of battered pilings 120, 122,124 and 126, arranged in a pyramid configuration. The bottom of the pilings 120 and 122 are shown with additional anchor, such as cable 128 and 130 extending into and anchored at 132 and 134 in the rock formation 119. This anchors the fixed point or anchor 118 against uplifting forces.

The anchoring point 118 is mounted within an accessible opening 136 in the platform or foundation 112, and is separated therefrom by means of dampers 138, 140, and 142. A bridge piling structure 144 is illustrated mounted on top of the platform 112.

As illustrated, when earthquake forces are imposed upon the bridge structure, the platform 112 moves laterally as shown by the arrow, while the vertical pilings 114 and 116 flex laterally. The platform as it is displaced is resisted by the flexing of the pilings and in addition by the dampers 138, 140 and 142, attached to the fixed anchor point 118. Thus, the fixed point damping system according to the invention supplements the primary support structure of the man-made structure, as it resists the forces of an earthquake. The lateral forces applied to the anchor 118 is resisted and imposes tension forces on pilings 122 and 124 and compressive forces on pilings 120 and 126. These forces try to lift the pilings 122 and 124 resulting in an uplifting force on the anchor.

Figure 7:
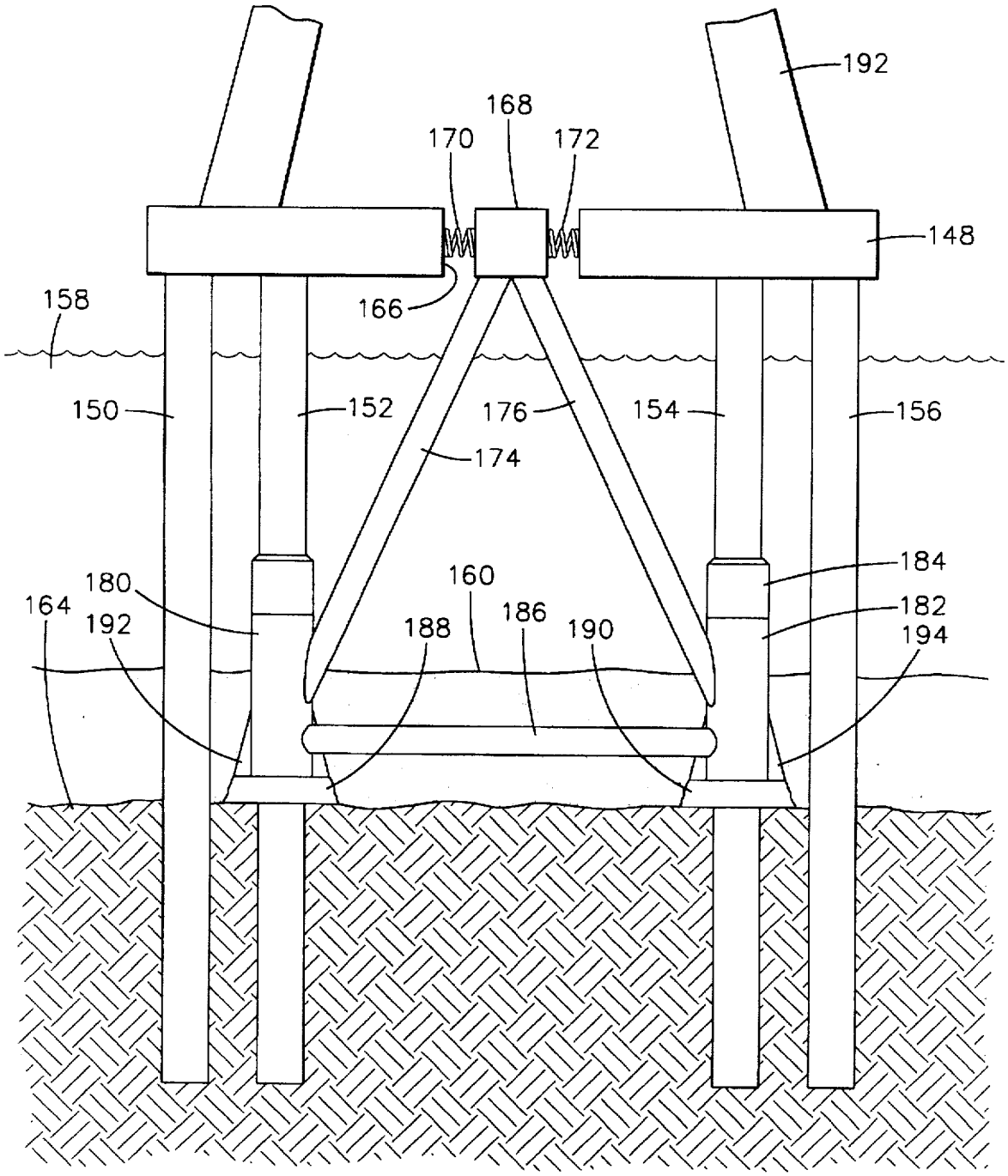
FIG. 7 is an elevation view of another embodiment of the invention applied to a bridge structure.

Referring now to FIG. 7 of the drawings, a further embodiment is illustrated wherein a foundation 148 is supported, as in prior embodiments, atop a plurality of rows of vertical pilings 150, 152, 154 and 156. The pilings, as in prior embodiments, support the foundation 148 above water level 158 and extend down through soil formation 160 into and is anchored into rock formation 164.

The platform or foundation 148 includes a central hole or aperture 166 in which is positioned a fixed anchor 168 connected to the foundation by dampers 170 and 172. The fixed point or anchor 168 is mounted atop a plurality of battered pilings in a pyramid arrangement, only two of which are shown, 174 and 176. In this embodiment the pilings 174 and 176 are secured at their lower ends directly to the inner row of pilings 152 and 154. As illustrated, the lower end of piling 174 is provided with a sleeve 178 which receives the piling 152 inserted down therethrough when it is installed. The piling 152 has a steel collar 180 which abuts against the top of sleeve 178 and may be welded thereto. Similarly, the piling 176 has a sleeve 182 which receives the piling 154 which includes a collar 184 that is welded to the upper end of the sleeve 182.

The sleeves 178 and 182 may be secured together by means of a transverse or cross-beam 186, as illustrated. In this instance, the vertical pilings may be secured in bores in the rock formation by concrete or the like and provide concrete pads 188 and 190 which are cast in place after installation and provide support for and compression for the lower ends of the pilings 174 and 176. The sleeves 178 and 182 are provided with outwardly extending feet 192 and 194 for engaging and resting on the top of concrete pads 188 and 190. The illustrated structure is shown supporting a bridge pylon 192.

While I have illustrated and described my invention by means of specific embodiments, it is to be understood that numerous changes and modifications may be made therein without departing from the spirit and the scope of the invention as defined in the appended claims.

I claim:

1. A seismic damping system for a man made structure, comprising:

a foundation for supporting said structure, said foundation constructed to enable lateral movement during an earthquake;

fixed anchoring means within the lateral perimeter of said foundation in an accessible position to enable inspection and repair of said anchoring means; and damping means connected in a common horizontal plane between said foundation and said anchoring means for damping seismic movement of said foundation.

2. A seismic damping system according to claim 1 wherein said damping means is disposed in and connected to said foundation in said common plane.

3. A seismic damping system according to claim 2 wherein said foundation is supported on pilings.

4. A seismic damping system according to claim 3 wherein said anchoring means includes an array of pilings.

5. A seismic damping system according to claim 4 wherein said array of pilings is in the form of a pyramid.

6. A seismic damping system according to claim 3 wherein said damping means comprises a plurality of viscous dampers arranged radially around said anchoring means.

7. A seismic damping system according to claim 3 wherein said damping means comprises a plurality of hydraulic jacks arranged radially around said anchoring means.

8. A seismic damping system for a building structure, comprising:

a foundation for supporting said structure;

a plurality of vertical pilings anchored in an earth formation supporting said foundation;

a fixed anchor disposed in an accessible position within the lateral perimeter of said foundation;

a plurality of battered pilings supporting said fixed anchor in position; and damping means disposed and connected in a common horizontal plane between said foundation and said anchor for damping movement resulting from seismic forces on said foundation.

9. A seismic damping system according to claim 8 wherein said battered pilings is in the form of a tripod.

10. A seismic damping system according to claim 8 wherein said damping means comprises a plurality of viscous dampers arranged radially around said anchor.

11. A seismic damping system according to claim 8 wherein said damping means comprises a plurality of hydraulic jacks arranged radially around said anchor.

12. A seismic damping system for a man made structure, comprising:

a foundation supported on vertical pilings for supporting said structure;

fixed anchoring means including an anchoring point mounted on battered pilings in an accessible position centrally of said foundation, said battered pilings are connected to said vertical pilings at ground level; and damping means connected between said foundation and said anchor for damping seismic movement of said foundation.

13. A seismic damping system according to claim 12 wherein said damping means comprises a plurality of hydraulic jacks arranged radially around said anchoring means.

14. A seismic damping system according to claim 13 wherein said damping means is disposed in and connected to said foundation in a common plane.

15. A seismic damping system according to claim 14 wherein said battered pilings are connected to said vertical pilings by means of sleeves surrounding said vertical pilings.

16. A seismic damping system according to claim 15 wherein said battered pilings are connected to said vertical pilings by means of a horizontal beam connected to said sleeves.

17. A seismic damping system for a building structure, comprising:

a foundation for supporting said structure;

a plurality of vertical pilings anchored in an earth formation supporting said foundation;

a fixed anchor disposed in an accessible position in a common plane centrally of said foundation;

a plurality of battered pilings in the form of a tripod supporting said fixed anchor in position, said battered pilings are connected to said vertical pilings substantially at ground level; and damping means connected between said foundation and said anchor in said common plane for damping seismic forces on said foundation.

18. A seismic damping system according to claim 17 wherein said battered pilings are connected to said vertical pilings by means of sleeves surrounding said vertical pilings.

19. A seismic damping system according to claim 18 wherein said battered pilings are connected to said vertical pilings by means of a horizontal beam connected to said sleeves.

* * * * *